US007770564B2

(12) United States Patent
Emerick et al.

(10) Patent No.: US 7,770,564 B2
(45) Date of Patent: Aug. 10, 2010

(54) DIFFUSER PLATE FOR IMPROVED MIXING OF EGR GAS

(75) Inventors: Greg L. Emerick, Columbus, IN (US); Gary Joyce, Columbus, IN (US)

(73) Assignee: Cummins, Inc., Columbus, IN (US)

( * ) Notice: Subject to any disclaimer, the term of this patent is extended or adjusted under 35 U.S.C. 154(b) by 290 days.

(21) Appl. No.: 11/931,032

(22) Filed: Oct. 31, 2007

(65) Prior Publication Data

US 2009/0107130 A1 Apr. 30, 2009

(51) Int. Cl.
*F02B 47/08* (2006.01)
*F02M 25/07* (2006.01)

(52) U.S. Cl. ..... 123/568.17; 366/174.1; 366/337; 366/340; 366/343

(58) Field of Classification Search ..... 123/568.17, 123/568.18; 366/174.1, 337, 340, 343
See application file for complete search history.

(56) References Cited

U.S. PATENT DOCUMENTS 4,361,128 A * 11/1982 Goldman et al. ..... 123/592
4,496,379 A * 1/1985 Kozawa ..... 96/130
4,648,373 A * 3/1987 Noguchi et al. ..... 123/568.17
4,810,428 A * 3/1989 Aly et al. ..... 261/96
5,388,559 A * 2/1995 O'Keefe ..... 123/593
5,456,533 A * 10/1995 Streiff et al. ..... 366/173.1
5,685,281 A * 11/1997 Li ..... 123/590
5,947,081 A * 9/1999 Kim ..... 123/306
6,076,499 A * 6/2000 Klumpp ..... 123/337
6,612,295 B2 * 9/2003 Lerner ..... 123/593
6,840,212 B2 * 1/2005 Kim ..... 123/306
6,932,049 B2 * 8/2005 Kim ..... 123/306

* cited by examiner

*Primary Examiner*—Hieu T Vo
*Assistant Examiner*—Raza Najmuddin
(74) *Attorney, Agent, or Firm*—Studebaker & Brackett PC; Tim L. Brackett, Jr.; J. Bruce Schelkopf

(57) ABSTRACT

An apparatus configured for the mixing of two fluids traveling in substantially perpendicular directions. The apparatus includes a cylindrical member including a longitudinal conduit. The member also includes at least one diffusing plate. The diffusing plate includes a surface with a larger area and a surface with a smaller area. The larger area surface includes a plurality of apertures. The bore directs one of the fluids onto the larger area of the diffusing plate and through the apertures. The smaller surface of the diffusing plate is orientated in the direction of travel of the second fluid.

18 Claims, 4 Drawing Sheets

DIFFUSER PLATE FOR IMPROVED MIXING OF EGR GAS

FIELD OF THE INVENTION

The present invention generally relates to exhaust gas recirculation systems in vehicles, and more particularly, to a diffuser plate configured for use in an exhaust gas recirculation system.

BACKGROUND OF THE INVENTION

Diesel engines include cylinders that combust a mixture of compressed air and diesel fuel. Frequently, exhaust gas recirculation (EGR) is utilized to minimize generally undesirable emissions, such as NOx emissions, during the combustion of the diesel fuel. The utilization of exhaust gas recirculation during combustion often impacts fuel economy, especially in turbocharged diesel engines.

In traditional EGR systems, the poor mixing of EGR gas with fresh air may result in an uneven distribution of the recirculated exhaust gas provided to the cylinders of the engine. Accordingly, some of the engine cylinders may become overloaded with EGR gases while other cylinders may receive very little EGR gas. Moreover, when the EGR flow rates are increased, the poor EGR mixing may result in a large increase in engine-out smoke emissions. In an attempt to even the distribution of the EGR gas throughout the cylinders, traditional mixer designs often result in a fresh air intake restriction.

SUMMARY OF THE INVENTION

An exemplary embodiment of the invention comprises an apparatus including a connecting portion and at least one plate. The connecting portion includes a bore, and the at least one plate includes a plurality of apertures. The plate may be connected to the bore and located in a plane that is not perpendicular to a longitudinal axis extending through the bore.

In embodiments of the invention, the apparatus includes an elongated member connecting the connecting portion to the plate. The apparatus may include two plates, and the plates may include four apertures each.

In embodiments of the invention, the connecting portion includes a cylindrical member and a plate. The plate may include an aperture and the cylindrical member may include the bore. The aperture of the plate may substantially align with the bore of the cylindrical member.

An embodiment of the invention comprises an apparatus configured to facilitate the mixing of two fluids flowing in substantially perpendicular directions. The apparatus includes a connecting portion, a diffusing portion and an intermediate portion. The connecting portion includes a bore extending in a first direction. The diffusing portion includes at least one plate, and the intermediate portion connects the connecting portion to the diffusing portion. The plate of the diffusing portion may be arranged to substantially minimize the surface area exposed to a second direction, which may be perpendicular to the first direction.

An embodiment of the invention comprises a mixer apparatus configured to mix a first fluid flowing in a first direction and a second fluid flowing in a second direction. The mixer apparatus may include a housing, a first aperture, a second aperture, a third aperture and a mixing member. The housing defines a mixing chamber. The first aperture is formed in the housing and is configured to allow the first liquid to flow into the mixing chamber in substantially the first direction. The second aperture is formed in the housing and is configured to allow the second liquid to flow into the mixing chamber in substantially the second direction. The third aperture is formed in the housing and is configured to allow a mixed combination of the first fluid and the second fluid to exit the mixing chamber. The mixing member is configured to mix the first fluid and the second fluid, and the mixing member includes a connector portion and a diffuser portion. The connector portion includes a bore extending in a direction substantially parallel to the first direction, and the connector portion is at least partially located in the first aperture.

BRIEF DESCRIPTION OF THE DRAWINGS

The above-mentioned and other features of this invention and the manner of obtaining them will become more apparent and the invention itself will be better understood by reference to the following description of an embodiment of the present invention taken in conjunction with the accompanying drawing, wherein.

Figure 1:
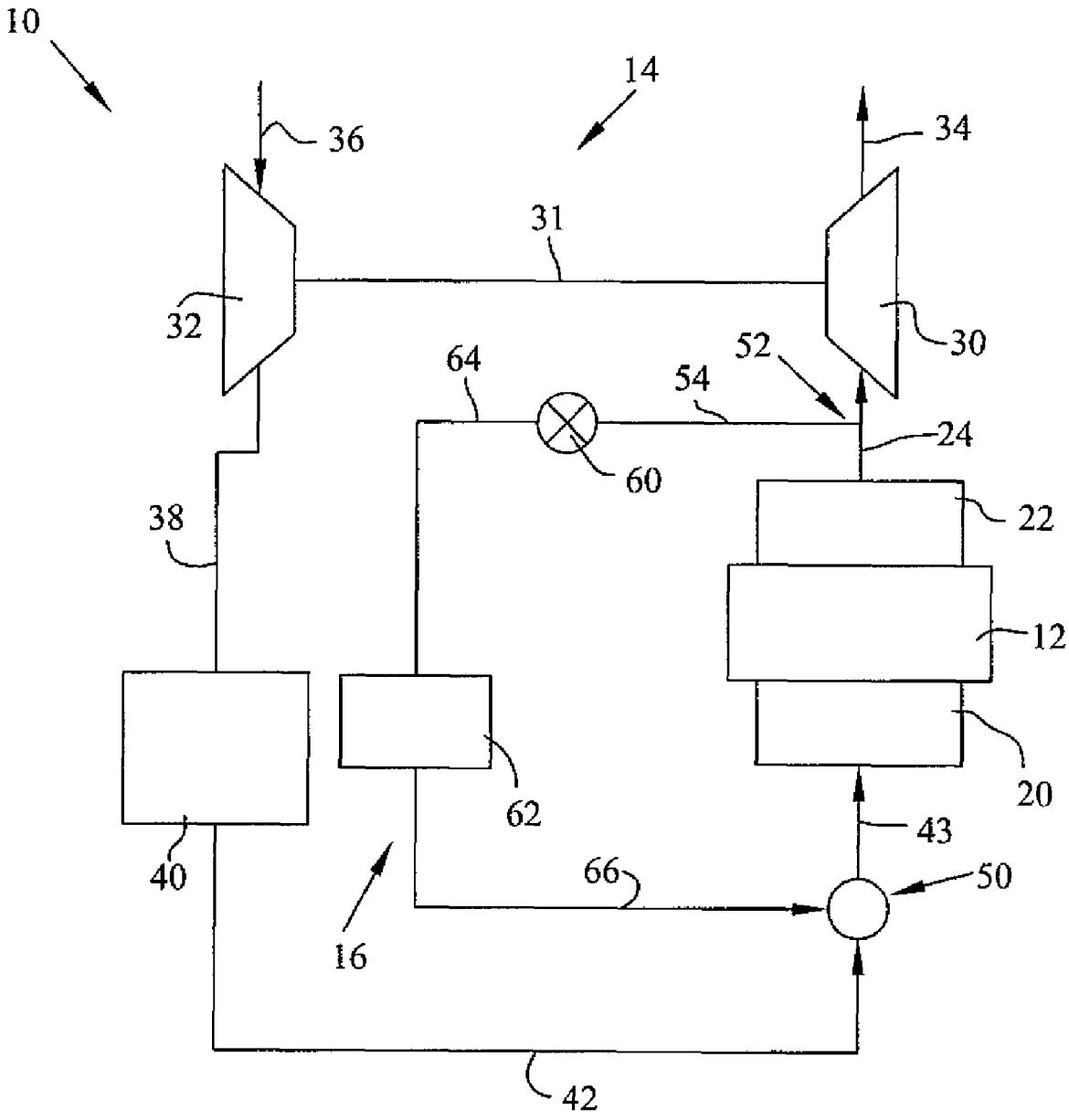
FIG. 1 depicts a representative diagram of a portion of a system incorporating an embodiment of the present invention.

Although the drawings represent an embodiment of various features and components according to the present invention, the drawings are not necessarily to scale and certain features may be exaggerated in order to better illustrate and explain the present invention. The exemplification set out herein illustrates an embodiment of the invention, and such exemplification is not to be construed as limiting the scope of the invention in any manner.

DESCRIPTION OF AN EMBODIMENT OF THE INVENTION

For the purposes of promoting an understanding of the principles of the invention, reference will now be made to the embodiment illustrated in the drawings, which are described below. It will nevertheless be understood that no limitation of the scope of the invention is thereby intended. The invention includes any alterations and further modifications in the illustrated device and further applications of the principles of the invention, which would normally occur to one of ordinary skill in the art to which the invention relates. Moreover, the described embodiment was selected for description to enable one of ordinary skill in the art to practice the invention.

FIG. 1 depicts a system, generally indicated by numeral 10, including an exemplary embodiment of the present invention. In the depicted embodiment, system 10 includes an engine 12, a turbocharger, generally indicated by numeral 14, and an exhaust recirculation system, generally indicated by numeral 16. Engine 12 may be any suitable engine known in the art, such as a diesel engine, for example. In the depicted embodiment, engine 10 includes an intake manifold 20 and an exhaust manifold 22.

In the depicted embodiment, conduit 24 connects exhaust manifold 22 to turbocharger 14. Turbocharger 14 includes a turbine 30 and a compressor 32. In a conventional manner, exhaust gas flowing through turbine 30 and out exhaust 34 causes turbine 30 to turn compressor 32 by way of linkage 31.

The turning of compressor 32 compresses the air being brought into the system 10 through inlet 36.

Conduit 38 conducts compressed air to a charge air cooler 40. The charge air cooler 40 may be configured to cool the compressed air in any suitable manner. In addition, charge air cooler 40 may be any suitable cooler known in the art. In the depicted embodiment, conduit 42 conducts the cooled and compressed air from cooler 40 to the mixer, generally indicated numeral 50.

Referring still to FIG. 1, a junction, generally indicated by numeral 52, connects conduit 24 to EGR system 16. In the depicted embodiment, EGR system 16 includes a valve 60 and a cooler 62.

In the depicted embodiment, junction 52 may direct a portion of the exhaust gases flowing through conduit 24 toward turbine 30 into conduit 54. Valve 60 controls the amount of exhaust gas that flows into conduit 54 from conduit 24. For example, when valve 60 is closed, no exhaust gas flows into conduit 54 from conduit 24. However, when valve 60 is at least partially open, exhaust gas flows into conduit 54 from conduit 24. The gas flowing through conduit 54 passes through valve 60 and flows into conduit 64. The exhaust gas flowing through conduit 64 flows into cooler 62. Cooler 62 may be any suitable cooler capable of cooling the exhaust gas as the gas flows through the cooler 62. As the gas exits cooler 62, conduit 66 conducts the cooled exhaust gas into mixer 50.

In the depicted embodiment of system 10, mixer 50 combines the cooled compressed air flowing through conduit 42 and the cooled exhaust gas flowing through conduit 66. The resulting mixture exits mixer 50 and passes through conduit 43 into intake manifold 20 for purposes of combustion within engine 12.

Figure 2:
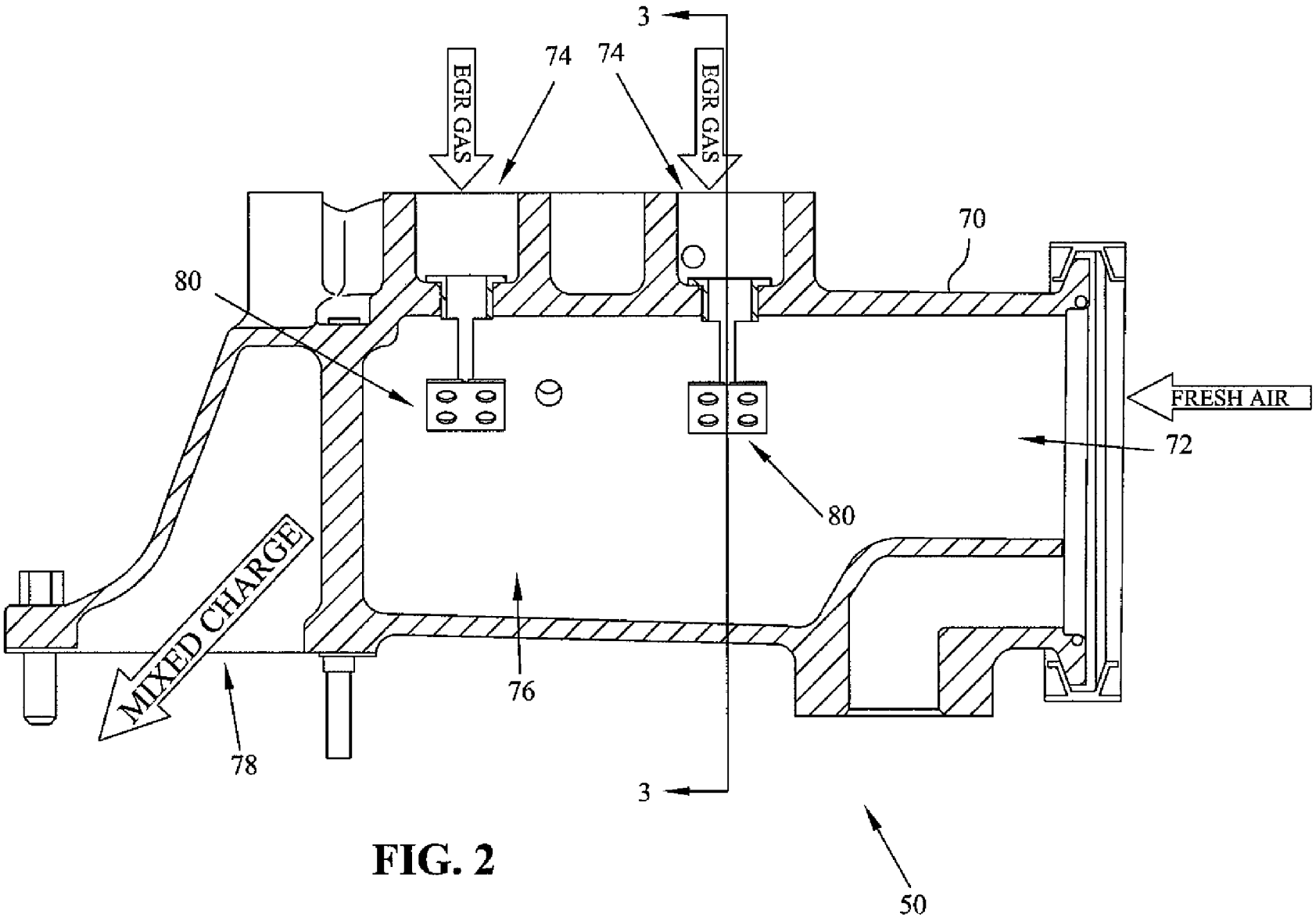
FIG. 2 depicts a section view of a mixer apparatus utilized in the system depicted in FIG. 1.
Figure 3:
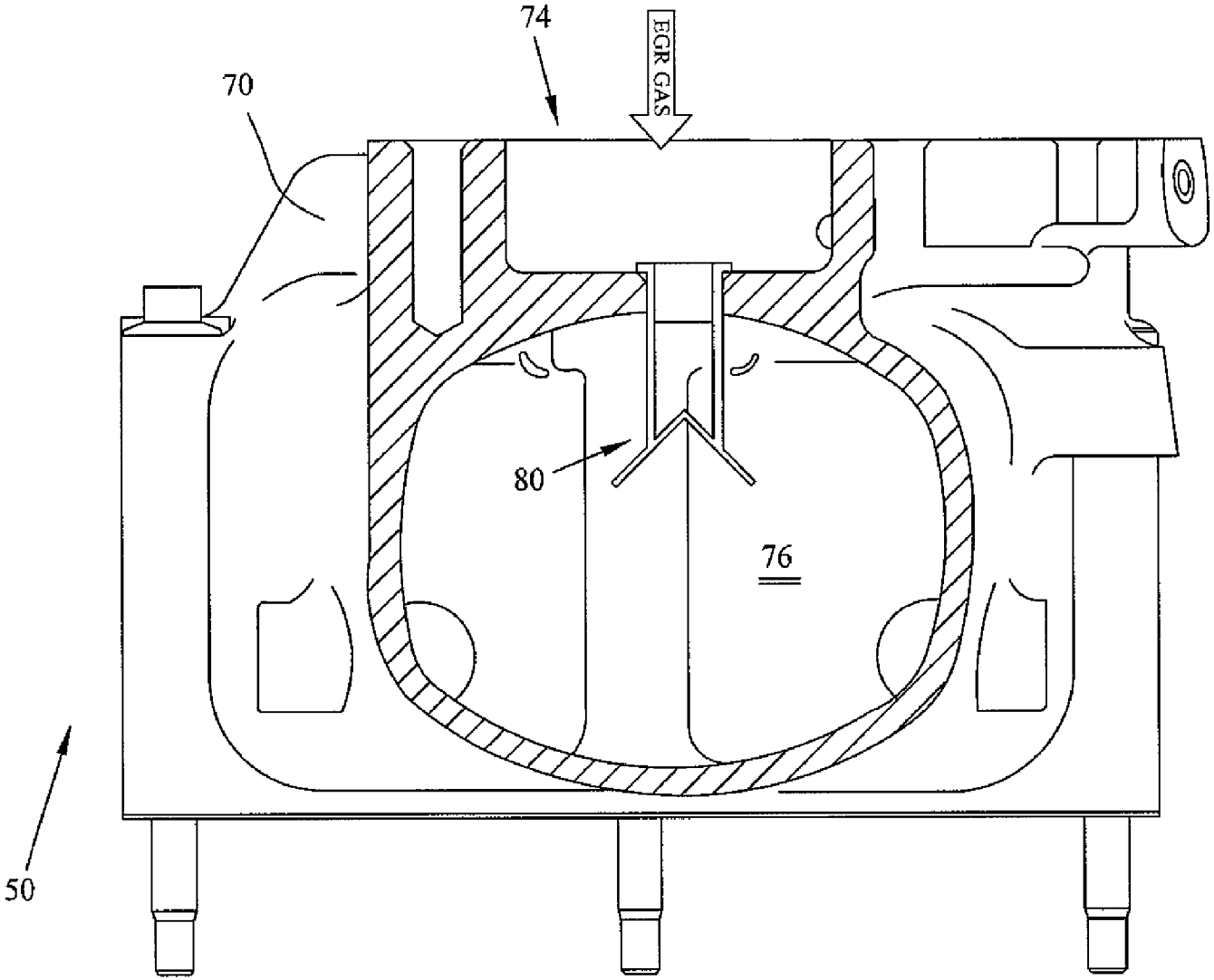
FIG. 3 depicts a second section view of the mixer apparatus depicted in FIG. 2 taken along line 3-3.

With reference now to FIGS. 2 and 3, an embodiment of mixer 50 will be described in greater detail. Mixer 50 includes a housing 70 and a plurality of assemblies, each indicated by numeral 80. Housing 70 includes a fresh air inlet 72, a plurality of EGR inlets, each indicated by numeral 74, a mixing chamber, generally indicated by numeral 76, and outlet 78. With respect to FIGS. 1 and 2, fresh air inlet 72 is generally connected to conduit 42, which conducts the cooled compressed inlet air into the mixer 50. It should be noted that inlet 72 may be connected to conduit 42 in any suitable manner. Similarly, the EGR inlets 74 may be connected to conduit 66 in any suitable manner. Conduit 66 conducts exhaust gas from cooler 62 to mixer 50.

With reference again to FIGS. 2 and 3, in the depicted embodiment of the mixer 50, the air entering through inlet 72 and the EGR gas entering through the EGR inlets 74 mix in the mixing chamber 76. The mixed gas then exits the mixing chamber 76 by way of outlet 78. In the depicted embodiment, outlet 78 may be connected to conduit 43 in any suitable manner, and conduit 43 conducts mixed air from the mixer 50 to the intake manifold 20.

In the depicted embodiment, each of the EGR gas inlets 74 has a mixer apparatus 80 located therein. The mixer apparatus 80 generally facilitates the mixing of the EGR gas with the inlet air without substantially restricting the flow of the inlet air.

Figure 4:
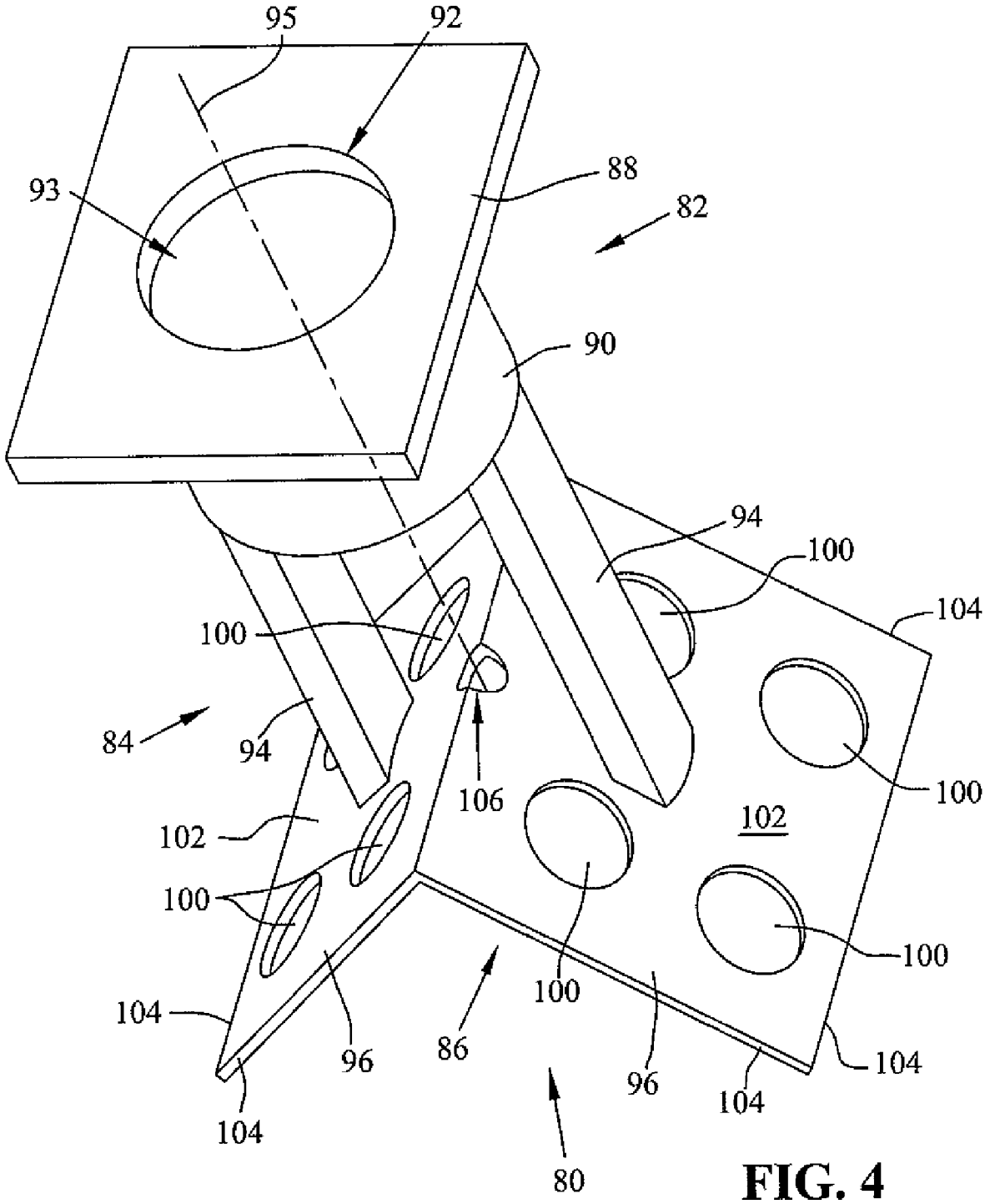
FIG. 4 depicts an embodiment of a mixing member utilized in the mixer apparatus depicted in FIGS. 2 and 3.

With reference now to FIG. 4, a mixer apparatus 80 includes a connecting portion, indicated by numeral 82, an intermediate portion, indicated by numeral 84, and a diffusing portion, indicated by numeral 86. In the depicted embodiment, connecting portion 82 includes an upper plate 88 and a cylindrical member 90. Upper plate 88 includes an aperture, generally indicated by numeral 92, and cylindrical member 90 includes a central bore 93. Central bore 93 defines a longitudinal axis 95 extending substantially through its center. In the depicted embodiment, aperture 92 substantially aligns with the central bore 93.

The intermediate portion 84 includes a pair of elongated members 94. The elongated members 94 extend from cylindrical member 90 to the diffusing portion 86. The elongated members 94 may be connected to the connecting portion 82 or the diffusing portion 86 in any suitable manner. It should be noted that in embodiments, apparatus 80 may be in a single piece, with the elongated members 94 integrally connected to connecting portion 82 and diffusing portion 86. In other embodiments, apparatus 80 may comprise various separate components that may be assembled in any suitable manner.

Referring still to FIG. 4, diffusing portion 86 includes a pair of plates each indicated by numeral 96. In the depicted embodiment, each plate 96 is connected to one of the members 94 and arranged in a plane that is not perpendicular to the longitudinal axis 95. Each of the plates 96 includes a plurality of apertures each indicated by numeral 100. The plates 96 have a rectangular shape and include a major surface 102 and minor surfaces 104. Major surface 102 has a larger area than the minor surfaces 104. The plates 96 together define an aperture 106. The apertures 100, 106 may have any suitable shape.

The plates 96 are angled downward from the intermediate portion 84. It should be noted that the plates 96 may be arranged in any orientation. For example, the plates 96 may extend perpendicular to axis 95 or extend upwards from axis 95.

With reference now to FIGS. 2 through 4, the mixer apparatuses 80 are arranged so that substantially only a minor surface 104 of the plates 96 is directed toward the fresh air inlet 72 of the mixer 50. In addition, only major surface 102 is directed toward the EGR inlets 74. The mixer apparatuses 80 may be retained within inlets 74 in any suitable manner. For example, the apparatuses 80 may be press fit into EGR inlets 74. In other embodiments, the cylindrical member 90 may be located within the inlet 74 and plate 88 sits outside of the bore.

In operation, the mixer apparatuses 80 increase the intermixing of the fresh air entering the mixing chamber 76 through fresh air inlet 72 and EGR gas entering the mixing chamber 76 through the EGR inlets 74. Specifically, once EGR gas flows through the aperture 92 and bore 93 of the mixing apparatus 80, the EGR gas then contacts the plates 96. A portion of the EGR gas will flow through the apertures 100, 106 of the plates 96 in order to intermix with the fresh air entering the mixing chamber 76 through the fresh air inlet 72. In addition, a portion of the EGR gas will contact the plates 96 and be directed toward the sides of the mixing chamber 76 in order to intermix with the fresh air located at the sides of the mixing chamber 76. In this manner, the mixing apparatuses 80 facilitate the mixing of the EGR gases and the fresh air present within the mixing chamber 76. It should be noted that since the mixing apparatuses 80 are arranged within the mixing chamber 76 with a minor surface 104 of the plates 96 directed toward the fresh air inlet 72, the mixing apparatuses 80 produce a minimal reduction in the flow rate of the fresh air within mixing chamber 76. Accordingly, the combined EGR gas and fresh air exits the mixing chamber 76 through the outlet 78 at a higher flow rate than would be achieved if the profile of the plates 96, with respect to the fresh air inlet 72, was not minimized. Furthermore, the mixing apparatuses 80 also ensure the combined air and EGR gas combination exiting the outlet 78 is substantially more uniform in its composition than if the mixing apparatuses 80 were not present. It should be noted that the mixer apparatus 80 may be utilized to mix a variety of fluids.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. An apparatus for mixing fluids flowing into a mixing chamber of an engine comprising:

a connecting portion including a bore to direct fluid into mixing chamber; and at least one plate including a plurality of apertures and connected to the bore, said at least one plate including a major surface directed toward the bore and extending across a flow of fluid flowing from said bore; and wherein said major surface of the at least one plate is located in a plane that is transverse to a longitudinal axis extending through the bore to cause fluid flow from said bore to contact said at least one plate, further including an elongated member connecting the connecting portion to the at least one plate so that said bore is spaced from said at least one plate by said elongated member.

2. The apparatus as set forth in claim 1 wherein the at least one plate includes two plates.

3. The apparatus as set forth in claim 1 wherein the at least one plate includes four apertures.

4. The apparatus as set forth in claim 1 wherein the connecting portion includes a cylindrical member and a plate.

5. The apparatus as set forth in claim 4 wherein the plate of the connecting portion includes an aperture and the cylindrical member includes the bore, and the aperture substantially aligns with the bore.

6. An apparatus configured to facilitate the mixing of a first fluid flowing in a first direction and a second fluid flowing in a second direction, comprising:

a connecting portion including a bore extending in the first direction to direct the first fluid in the first direction;

a diffusing portion including at least one plate; and an intermediate portion connecting the connecting portion to the diffusing portion;

wherein the at least one plate is arranged to substantially minimize surface area of the plate exposed to the second fluid flowing in the second direction that is substantially perpendicular to the first direction.

7. The apparatus as set forth in claim 6 wherein the diffusing portion includes two plates.

8. The apparatus as set forth in claim 6 wherein the at least one plate includes a plurality of apertures.

9. The apparatus as set forth in claim 8 wherein the at least one plate includes four apertures.

10. The apparatus as set forth in claim 6 wherein the at least one plate includes a first surface facing the first direction and having a larger area than a second surface facing the second direction.

11. The apparatus as set forth in claim 6 wherein the intermediate portion includes a pair of elongated members.

12. The apparatus as set forth in claim 6 wherein the connecting portion includes a cylindrical member including the bore.

13. A mixer apparatus configured to mix a first fluid flowing in a first direction and a second fluid flowing in a second direction comprising:

a housing defining a mixing chamber;

a first aperture formed in the housing and configured to allow the first fluid to flow into the mixing chamber in substantially the first direction;

a second aperture formed in the housing and configured to allow the second fluid to flow into the mixing chamber in substantially the second direction;

a third aperture formed in the housing and configured to allow a mixed combination of the first fluid and the second fluid to exit the mixing chamber; and a mixing member positioned in the mixing chamber and configured to mix the first fluid and the second fluid, the mixing member including a connector portion and a diffuser portion, the connector portion including a bore extending in a direction substantially parallel to the first direction;

wherein the connector portion is at least partially located in the first aperture.

14. The mixer apparatus as set forth in claim 13 wherein the diffuser portion includes at least one plate including a plurality of apertures.

15. The mixer apparatus as set forth in claim 14 wherein the diffuser portion includes two plates.

16. The mixer apparatus as set forth in claim 13 wherein the first direction is substantially perpendicular to the second direction.

17. The mixer apparatus as set forth in claim 13 wherein the diffuser portion is at least partially located in the mixing chamber.

18. The mixer apparatus as set forth in claim 13 wherein the diffuser portion includes a first surface directed toward the first direction and a second surface directed toward the second direction, an area of the first surface being greater than an area of the second surface.

* * * * *